United States Patent [19]

Morita

[11] 4,402,298

[45] Sep. 6, 1983

[54] IGNITION SYSTEM TRIGGER CIRCUIT FOR INTERNAL COMBUSTION ENGINES

[75] Inventor: Koji Morita, Hamamatsu, Japan

[73] Assignee: Yamaha Hatsudoki Kabushiki Kaisha, Iwata, Japan

[21] Appl. No.: 309,587

[22] Filed: Oct. 8, 1981

[30] Foreign Application Priority Data

Oct. 9, 1980 [JP] Japan ..... 55-141708

[51] Int. Cl.[3] ..... F02P 3/06; F02P 1/00

[52] U.S. Cl. ..... 123/599; 123/596; 123/605

[58] Field of Search ..... 123/599, 596, 605, 600, 123/601, 618, 622

[56] References Cited

U.S. PATENT DOCUMENTS

| | | | |
|---|---|---|---|
| 3,911,886 | 10/1975 | Nagasawa | 123/599 |
| 3,985,109 | 10/1976 | Kondo et al. | 123/599 |
| 4,015,564 | 4/1977 | Ritzner | 123/600 |
| 4,150,652 | 4/1979 | Nagusawa | 123/599 |
| 4,232,646 | 11/1980 | Asai | 123/600 |
| 4,346,690 | 8/1982 | Anderson | 123/599 |
| 4,366,801 | 1/1983 | Endo et al. | 123/605 |

FOREIGN PATENT DOCUMENTS 2921791 12/1979 Fed. Rep. of Germany ..... 123/596

*Primary Examiner*—Raymond A. Nelli

*Attorney, Agent, or Firm*—Ernest A. Beutler

[57] ABSTRACT

An improved trigger circuit for a magneto-type ignition system is described. The trigger circuit includes a first generating coil for supplying current flow to a primary winding of the ignition coil, a transistor for controlling the current flow through the primary winding, a capacitor, a thyristor for cooperating with the capacitor to render the transistor non-conductive, and a second generating coil for supplying the power required to charge the capacitor and to control the conduction of both the transistor and thyristor, such that the capacitor is charged and the transistor is rendered conductive by one half wave output from the second generating coil and the thyristor is rendered conductive by the other half wave output from the second generating coil. The conduction of the thyristor is operative to discharge the capacitor and render the transistor non-conductive, whereby the current flow from the first generating coil is directed through the primary winding of the ignition coil to induce a sparking potential in the secondary winding of the ignition coil.

7 Claims, 3 Drawing Figures

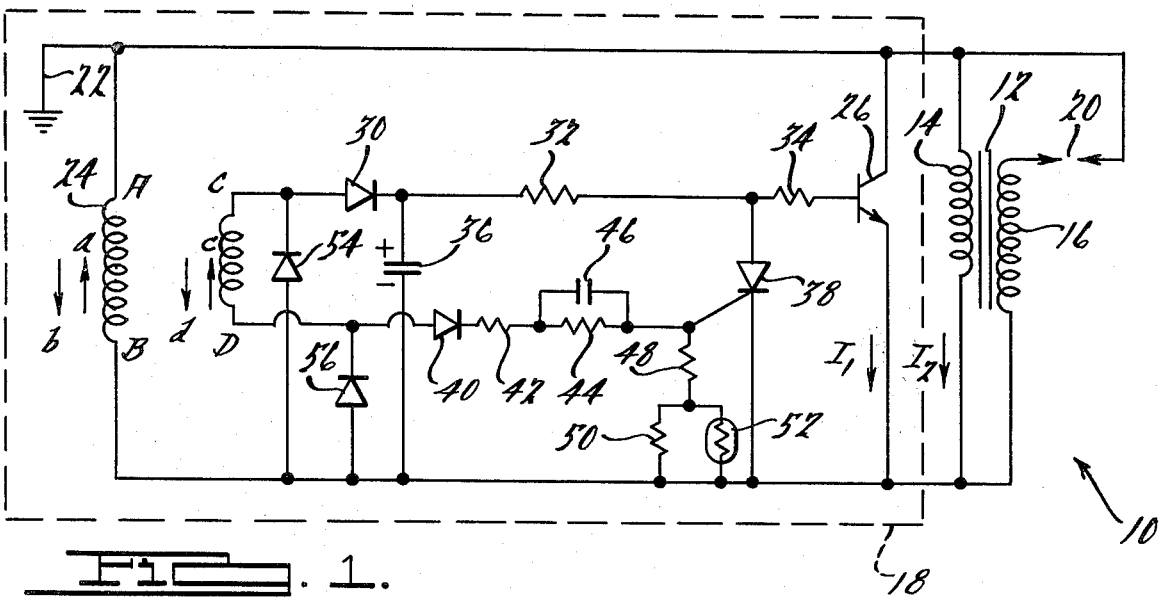
FIG. 1.
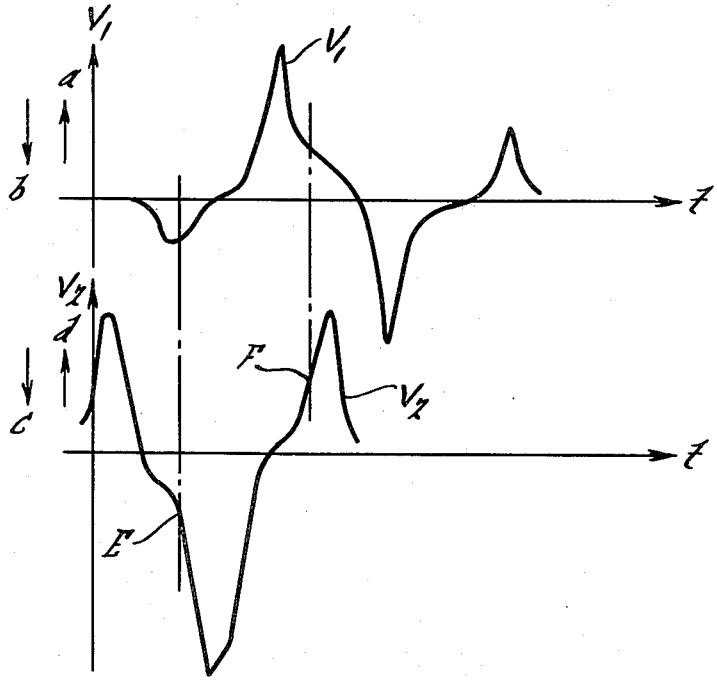
FIG. 2.
FIG. 3.
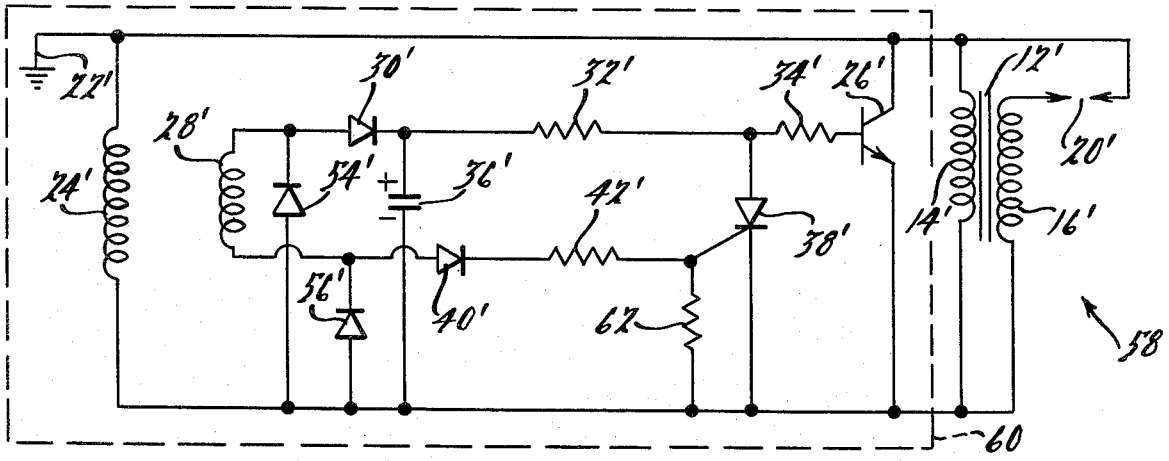

IGNITION SYSTEM TRIGGER CIRCUIT FOR INTERNAL COMBUSTION ENGINES

BACKGROUND AND SUMMARY OF THE INVENTION

The present invention relates generally to ignition systems for internal combustion engines and particularly to breakerless magneto-type ignition systems. The present invention provides an improved trigger circuit for inducing a sparking potential in a secondary winding of an ignition coil by abruptly changing the rate of current flow through the primary winding of the ignition coil.

In one prior art magneto-type ignition system, the trigger circuit includes a generating coil for supplying current flow to the primary winding of an ignition coil and a transistor connected in parallel with the primary winding to control the current flow through the primary winding. When rendered conductive, the current from the generating coil flows through the transistor, which acts as a short circuit across the primary winding. Subsequently, the current flow through the transistor is interrupted by turning off the transistor (rendering it non-conductive). At this time, the voltage generated is impressed upon the primary winding, causing an abrupt change in current flow through the primary winding and thereby inducing a sparking potential in the secondary winding. However, in this ignition system the power required to control the switching of the transistor, that is the power required to drive the base of the transistor, is provided by the generating coil. For example, the output voltage of the generating coil is divided by connecting the series circuit of a plurality of resistors in parallel with the generating coil so that the divided voltage is guided to the base of that transistor. Since the current output of the generating coil partially flows through those resistors, the current through the primary winding is reduced. As a result, the changing rate of current flow through the primary winding due to the interruption of the current flow through the transistor is also reduced, thereby decreasing the voltage induced in the secondary winding. It will be appreciated that the effect of this undesirable reduction in ignition performance is especially pronounced when the internal combustion engine is running at slow speeds, as the magnitude of the voltage output from the generating coil is lower than at high operating speeds.

Accordingly, it is a principle object of the present invention to provide a trigger circuit for a magneto-type ignition system, in which the magnitude of the voltage or sparking potential induced by the secondary winding of the ignition coil is increased by increasing the changing rate of the current flow through the primary winding, thereby improving the performance of the ignition system especially at slow engine speeds.

It is another object of the present invention to provide a trigger circuit which automatically advances the ignition timing with an increase in engine speed.

In accordance with the foregoing objects, the present invention provides a novel trigger circuit which features two generating coils, two semiconductor switching elements and a capacitor. The first generating coil is used to supply current flow to the primary winding of the ignition coil, and the first semiconductor switching element (a transistor) is connected across the primary winding in parallel to control current flow through the priimary winding. The second semiconductor switching element (a thyristor) is used to render the first semiconductor switching element non-conductive in cooperation with the capacitor. An important feature of the present invention is the second generating coil, which is used to supply the power required to charge the capacitor and to control the conduction of the first and second semiconductor switching elements. During one half wave voltage output of the second generating coil, the capacitor is charged and the first semiconductor switch is rendered conductive. During the other half wave of the voltage output from the second generating coil the second semiconductor switching element is rendered conductive. The conduction of the second semiconductor switching element is operative to discharge the capacitor and render non-conductive the first semiconductor switching element. This causes an interruption of the current flow through the first semiconductor switching element, and the current flow from the first generating coil is directed through the primary winding of the ignition coil to induce a sparking potential in the secondary winding of the ignition coil. Thus, it should be appreciated that since the first generating coil is not used to control any switching elements, all or substantially all of the current flow from this coil is directed through the primary winding, thereby increasing the changing rate of current flow through the primary winding.

Additional advantages and features of the present invention will become apparent from a reading of the detailed description of the preferred embodiments which makes reference to the following set of drawings in which:

BRIEF DESCRIPTION OF THE DRAWINGS

FIG. 1 is a circuit diagram illustrating one embodiment of the present invention.

FIG. 2 is a timing diagram with respect to the embodiment illustrated in FIG. 1.

FIG. 3 is a circuit diagram illustrating another embodiment of the present invention.

DETAILED DESCRIPTION OF THE PREFERRED EMBODIENTS

Referring to FIG. 1, a circuit diagram of a first embodiment of a magneto-type ignition system 10 according to the present invention is shown. The ignition system 10 is generally comprised of an ignition coil 12 having a primary winding 14 and a secondary winding 16, a trigger circuit 18 coupled across the primary winding 14 of the ignition coil, and a spark plug 20 connected between one terminal of the secondary winding 16 and an electrical ground 22. The trigger circuit 18 includes a first generating coil 24, which is connected across the primary winding 14 of the ignition coil 12 in parallel for supplying current flow to the primary winding. The first generating coil is arranged in a magneto-type dynamo (not shown), and is adapted to generate a time varying output voltage $V_1$ (alternating in the directions of arrows a and b) between its terminals A and B as the crankshaft of an internal combustion engine (not shown) rotates. FIG. 2 illustrates the varying magnitude of the output voltage $V_1$, with respect to time when both the terminals A and B of the first generating coil 22 are in an open circuit condition.

The trigger circuit 18 also includes a conventional NPN transistor 26, which is connected across the primary winding 14 of the ignition coil 12 for controlling the current flow through the primary winding. Specifically, the collector and emitter terminals of the transistor 26 are connected across the primary winding 14 such that the collector terminal is also connected to the electrical ground 22. The transistor 26 provides a semiconductor switching element which operates as a short circuit across the primary winding 14 when conducting or turned on, and operates as an open circuit when rendered non-conductive.

The trigger circuit 18 further includes a second generating coil 28 which is adapted to generate a time varying output voltage $V_2$ (alternating in the direction of arrows c and d) between its terminals C and D. FIG. 2 illustrates the varying magnitude of the output voltage $V_2$ with respect to time. It should be noted that the output voltage $V_2$ generated by the second generating coil 28 has a predetermined phase difference from the output voltage $V_1$ generated by the first generating coil 24. The terminal C of the second generating coil 28 is connected through a diode 30 and resistors 32 and 34 to the base terminal of the transistor 26. The diode 30 is connected between the second generating coil 28 and the resistor 32 such that its polarity will permit current flow from the second generating coil in the direction of the arrow c to be directed into the base terminal of the transistor 26.

The trigger circuit 18 also includes a capacitor or condenser 36, which is connected between the cathode of the diode 30 and the terminal B of the first generating coil 24. The trigger circuit 18 additionally includes a conventional thyristor 38 (also referred to as an SCR), which acts as a second semiconductor switching element and cooperates with the capacitor 36 to render the transsistor 26 non-conductive. The anode terminal of the thyristor 38 is connected between the resistors 32 and 34 and its cathode terminal is connected to the terminal B of the first generating coil. The gate terminal of the thyristor 38 is connected to the terminal D of the second generating coil 28 through a diode 40 and resistors 42 and 44. The polarity of the diode 40 is such that the diode will permit current to flow from the second generating coil 28 in the direction of the arrow d into the gate terminal of the thyristor 38. A capacitor 46 is connected across the resistor 44 and is used to shape the output waveform from the second generating coil 28 and ensure the operation of the thyristor 38. Resistors 48 and 50 are connected between the gate terminal of the thyristor 38 and the terminal B of the first generating coil 24, and operate to prevent a malfunction of the thyristor due to noise or induction. A thermistor 52 is connected in parallel with resistor 50 for compensating for changes in temperature. The trigger circuit 18 also includes a pair of diodes 54 and 56 for permitting current to flow into the second generating coil 28. Both the diodes 54 and 56 have their respective anodes connected to the terminal B of the first generating coil 24, with the cathode of the diode 54 being connected to the terminal C of the second generating coil 28 and the cathode of the diode 56 being connected to the terminal D of the second generating coil.

The operation of the trigger circuit 18 will now be described. When the output voltage $V_2$ of the second generating coil 28 is in the direction of the arrow c current flows from that coil through the diode 30 and resistors 32 and 34 into the base terminal of the transistor 26. The half wave output from the second generating coil 28 in the direction of the arrow c also charges the capacitor 36 (with the polarity indicated in FIG. 1) so that the base voltage of the transistor 26 is increased as the charge on the capacitor 36 is advanced. When that base voltage exceeds a predetermined voltage, the transistor 26 is turned on (i.e., rendered conductive). In FIG. 2, a point E indicates the timing at which the transistor 26 is turned on. In other words, the transistor 26 is turned on by the charging voltage of the condenser 11. It should be noted that even if the polarity of the output voltage $V_2$ of the second generating coil 28 is changed by the charge of the capacitor 36, the transistor 26 will temporarily continue to be in a conductive state.

When the transistor 26 is conducting and the output voltage $V_1$ generated by the first generating coil 24 is in the direction of the arrow a, a current $I_1$ will start to flow through the transistor. This current flow will be augmented with the increasing output voltage $V_1$ from the first generating coil 24.

When the polarity of the output voltage $V_2$ of the second generating coil 28 is inverted to the direction of the arrow d in accordance with the rotations of the magneto, a gate signal is fed from the second generating coil 28 via the diode 40, the resistors 42 and 44 and the capacitor 46 to the thyristor 38. It should be noted that at this time the transistor 26 is rendered conductive by the charge of the capacitor 36. When the output voltage $V_2$ in the direction of the arrow d reaches a predetermined potential such that the gate signal reaches the gate-trigger voltage of the thyristor 38, the thyristor is turned on (or rendered conductive). As a result, the charge on the capacitor 36 is abruptly discharged through the thyristor 38 so that the transistor 26 is turned off (or rendered inconductive). A point F appearing in FIG. 2 indicates the timing at which the transistor 26 is turned off. Consequently, the current $I_1$, which had been flowing from the first generating coil 24 to the transistor 26, is interrupted so that a current $I_2$ starts to abruptly flow into the primary winding 14 of the ignition coil 12. As a result, a high voltage is induced at the secondary winding 16 so that a spark is established at the spark plug 20. It should be noted that the thyristor 38 is rendered conductive by the other half wave output of the second generating coil 24, that is the half wave voltage output opposite that used to charge the capacitor 36 and turn on the transistor 26.

Thus, it should be appreciated that the power required to charge the capacitor 36 as well as to control the conduction of both the transistor 26 and the thyristor 38 is supplied by the second generating coil 28. Accordingly, all or substantially all of the current flow from the first generating coil 24 is directed through the primary winding 14 of the ignition coil 12, thereby increasing the changing rate of current flow through the primary winding 14. This causes a higher voltage to be induced in the secondary winding 16 of the ignition coil 12, which results in an improved ignition performance especially during lower engine speeds.

It should also be noted that when the output voltage $V_1$ of the first generating coil 24 is in the direction of the arrow b, the current from the first generating coil 24 flows through the diodes 54 and 30 and the resistors 32 and 34 and further between the base and collector of the transistor 26 in the forward direction independently of the direction of the output voltage $V_2$ of the second generating coil 28. Thus, it will be appreciated that no current flows through the primary winding 14 in the direction from the terminal B of the first generating coil 24 to the electrical ground 22, thereby preventing a prespark from being generated at the ignition plug 20. It will also be appreciated that it becomes unnecessary to connect another diode in parallel with the first generating coil 24 so as to shortcircuit the output voltage $V_1$ of that coil in the direction of the arrow b.

It is also important to note that the waveform of the output voltage $V_2$ from the second generating coil 28 will be steepened in response to an increase in the speed of the engine. This causes an advance in the time at which the gate signal reaches the gate-trigger voltage, thereby automatically advancing the time at which the thyristor 38 is rendered conductive.

Referring to FIG. 3, a circuit diagram of a second embodiment of a magneto-type ignition system 58 is shown. The ignition system 56 features a trigger circuit 60 which is very similar in construction and operation to the trigger circuit 18 of the first embodiment. Accordingly, for simplicity all elements of the trigger circuit 60 which correspond to those in the trigger circuit 18 are identified with their reference numerals primed.

The principle difference between the trigger circuit 60 and trigger circuit 18 is that the elements corresponding to resistor 44, capacitor 46 and thermistor 52 are not employed in the trigger circuit 60. Additionally, the resistors 48 and 50 of the trigger circuit 18 are represented as a single resistor 62 in the trigger circuit 60. Accordingly, it should be appreciated that the resistor 44, the capacitor 46 and the thermistor 52 are not necessary to the operation of the trigger circuit according to the present invention. Rather, these elements may be optionally included to give a high quality to the trigger circuit according to the present invention.

It will be appreciated that the above disclosed embodiment is well calculated to achieve the aforementioned objects of the present invention. In addition, it is evident that those skilled in the art, once given the benefit of the foregoing disclosure, may now make modifications of the specific embodiment described herein without departing from the spirit of the present invention. Such modifications are to be considered within the scope of the present invention which is limited solely by the scope and spirit of the appended claims.

What is claimed is:

1. In a magneto-type ignition system for internal combustion engines, a trigger circuit coupled to an ignition coil of said ignition system, comprising:

a first generating coil, connected in parallel with a primary winding of said ignition coil, for supplying current flow to said primary winding;

first switching means, also connected in parallel with said primary winding of said ignition coil, for controlling the current flow through said primary winding;

a capacitor in association with said first switching means;

second switching means, in association with said capacitor and said first switching means, for cooperating with said capacitor to render said first switching means non-conductive;

a second generating coil, in association with said capacitor and said first and second switching means, for supplying the power to charge said capacitor and to control the conduction of said first and second switching means, such that said capacitor is charged and said first switching means is rendered conductive by one half wave of the output from said second generating coil and said second switching means is rendered conductive by the other half wave output from said second generating coil;

the conduction of said second switching means being operative to discharge said capacitor and render non-conductive said first switching means, whereby the current flow from said first generating coil is directed through said primary winding of said ignition coil to induce a sparking potential in said secondary winding of said ignition coil.

2. The trigger circuit according to claim 1, wherein the output generated by said second generating coil has a predetermined phase difference from the output generated by said first generating coil.

3. The trigger circuit according to claim 2, including diode means for directing current flow through said trigger circuit, and impedance means for controlling the output levels of said second generating coil at which said first and second switching means are rendered conductive.

4. The trigger circuit according to claim 3, wherein the output waveform generated by said second generating coil is steepened in response to an increase in the speed of said internal combustion engine, thereby automatically advancing the time at which said second switching means is rendered conductive.

5. The trigger circuit according to claim 4, wherein said first switching means is a transistor whose collector and emitter terminals are connected across said primary winding of said ignition coil and across said first generating coil.

6. The trigger circuit according to claim 5, wherein said second switching means is a thyristor.

7. The trigger circuit according to claim 6, wherein said impedance means includes a thermistor in association with the gate terminal of said thyristor to compensate for changes in temperature.

* * * * *